US009611854B2

(12) United States Patent
Opel et al.

(10) Patent No.: US 9,611,854 B2
(45) Date of Patent: Apr. 4, 2017

(54) WASHER FLUID PUMP

(75) Inventors: Patrick Opel, Rotenburg (DE); Dirk Ringler, Friedewald (DE); Thomas Werner, Nentershausen (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 1431 days.

(21) Appl. No.: 12/102,190

(22) Filed: Apr. 14, 2008

(65) Prior Publication Data

US 2008/0253908 A1 Oct. 16, 2008

(30) Foreign Application Priority Data

Apr. 16, 2007 (DE) ..... 10 2007 017 769

(51) Int. Cl.

| | |
|---|---|
| ***F04B 35/04*** | (2006.01) |
| ***F04D 9/00*** | (2006.01) |
| ***F04D 5/00*** | (2006.01) |
| *F04D 29/58* | (2006.01) |
| *F04D 29/70* | (2006.01) |

(52) U.S. Cl.

CPC ..... *F04D 9/002* (2013.01); *F04D 5/002* (2013.01); *F04D 29/58* (2013.01); *F04D 29/708* (2013.01); *Y10T 29/49236* (2015.01)

(58) Field of Classification Search

CPC ..... F04D 9/002; F04D 5/002; F04D 29/58; F04D 29/708; F04D 13/06

USPC ..... 417/53, 423.9, 423.15, 423.11, 423.12, 417/423.13, 423.14, 424, 423.8, 423.1; 15/236.02, 321, 103, 220.1, 232; 310/88

See application file for complete search history.

(56) References Cited

U.S. PATENT DOCUMENTS

| | | | | |
|---|---|---|---|---|
| 2,663,243 | A * | 12/1953 | Wunderlich | 454/124 |
| 3,021,442 | A * | 2/1962 | Rodak | H02K 9/06 310/60 R |
| 3,576,380 | A | 4/1971 | Sargeant | 417/423 |
| 3,871,796 | A * | 3/1975 | Mack | 417/423.11 |
| 3,909,872 | A | 10/1975 | Molenaar | 15/250.02 |
| 4,114,231 | A * | 9/1978 | Nauta | 15/413 |
| 5,184,946 | A * | 2/1993 | Sato | 417/423.9 |

(Continued)

FOREIGN PATENT DOCUMENTS

| | | | |
|---|---|---|---|
| DE | 19846755 | 10/1998 | B60S 1/48 |
| DE | 19907561 A1 | 12/1999 | B60S 1/48 |

(Continued)

OTHER PUBLICATIONS

German Office Action, German Patent Application No. 102007017781.1, 4 pages, Jan. 12, 2012.

*Primary Examiner* — Devon Kramer
*Assistant Examiner* — Connor Tremarche
(74) *Attorney, Agent, or Firm* — Slayden Grubert Beard PLLC

(57) ABSTRACT

A washer fluid pump (2) for a windshield washer system (3) of a motor vehicle has ventilation ducts (25, 25') which are arranged in a housing (17) parallel to the longitudinal axis. The ventilation ducts (25, 25') open out behind bulkheads (21, 22) which are likewise arranged parallel to the longitudinal axis. The bulkheads (21, 22) bridge a constriction (20), which is arranged between an electric motor (15) and a pump stage (16), of the housing (17). In this way, the electric motor (15) is reliably protected against spray water. The washer fluid pump (2) can also be produced in a particularly cost-effective manner.

13 Claims, 5 Drawing Sheets

(56) References Cited

U.S. PATENT DOCUMENTS

| | | | | |
|---|---|---|---|---|
| 5,257,911 | A | 11/1993 | Mota et al. | 417/63 |
| 5,480,289 | A * | 1/1996 | Lee | 417/360 |
| 6,053,708 | A * | 4/2000 | Nishikawa | 417/360 |
| 6,109,891 | A | 8/2000 | Sato | 417/423.14 |
| 6,339,272 | B1 | 1/2002 | Sato | 310/87 |
| 6,524,085 | B2 * | 2/2003 | Shoda et al. | 417/423.14 |
| 6,530,758 | B1 * | 3/2003 | Ritter et al. | 417/423.14 |
| 6,554,565 | B2 * | 4/2003 | Suzuki et al. | 415/121.2 |
| 6,616,425 | B2 * | 9/2003 | Kober | F04D 13/06 310/88 |
| 7,284,969 | B2 * | 10/2007 | Akimoto et al. | 417/423.9 |
| 2002/0001528 | A1 * | 1/2002 | Shoda et al. | 417/360 |
| 2002/0085934 | A1 | 7/2002 | Kober | 417/421 |
| 2004/0170514 | A1 * | 9/2004 | Mota Lopez et al. | 417/423.14 |
| 2005/0063845 | A1 * | 3/2005 | Akimoto | F04D 29/708 417/423.9 |

FOREIGN PATENT DOCUMENTS

| | | | | |
|---|---|---|---|---|
| DE | 10061013 | | 12/2000 | B60S 1/48 |
| EP | 0466888 | A1 | 1/1992 | B60S 1/48 |
| EP | 1167774 | | 6/2001 | F04D 25/06 |
| WO | 2007/031404 | | 3/2007 | B60S 1/48 |

* cited by examiner

WASHER FLUID PUMP

CROSS-REFERENCE TO RELATED APPLICATIONS

This application claims priority to German Patent Application Number 10 2007 017 769.2 filed on Apr. 16, 2007, and which is incorporated herein by reference in its entirety.

TECHNICAL FIELD

A washer fluid pump for a windshield washer system of a motor vehicle having a housing and having an electric motor, having a pump stage which can be driven by the electric motor and having a ventilation opening, which is arranged behind a bulkhead, of the electric motor.

BACKGROUND

Washer fluid pumps of said type are, in modern windshield washer systems, often mounted on a washer fluid tank and are known from practice. The ventilation opening serves for climate and pressure compensation of the housing which at least partially holds the electric motor, and is for example formed as an open end of a ventilation duct which is guided straight through the housing. Here, the ventilation opening must be large enough to permit an infiltration of air into the housing and a discharge of air out of the housing. An excessively small ventilation opening tends to become blocked, which often leads to a pressure build-up and to damage of sealing elements between the electric motor and the pump stage or to foreign objects being sucked into the interior of the electric motor.

An excessively large opening, in contrast, leads to an infiltration of spray water into the electric motor. In both cases, the washer fluid pump can be damaged and spontaneously fail.

It has already been considered to guide the ventilation duct radially out of the housing and to arrange a bulkhead in front of the ventilation opening. This however leads to very complex production of the washer fluid pump.

SUMMARY

There exists a need for refining a washer fluid pump of the type specified in the introduction in such a way that it offers reliable protection against spray water and can be produced in a particularly cost-effective manner.

According to an embodiment, a washer fluid pump for a windshield washer system of a motor vehicle may comprise a housing, an electric motor, a pump stage which can be driven by the electric motor and a motor ventilation opening, which is arranged behind a bulkhead, wherein the bulkhead and a section of the housing which faces toward the pump stage are produced in one piece and wherein a ventilation duct which is guided from the interior of the electric motor up to behind the bulkhead to the motor ventilation opening is arranged parallel to the bulkhead.

According to a further embodiment, the housing may have a section of the electric motor which faces toward the pump stage, and a section of the pump stage which faces toward the electric motor, wherein the two sections are produced in one piece, and wherein a constriction is arranged between the two sections and wherein the bulkhead partially overlaps the constriction. According to a further embodiment, a plurality of bulkheads and ventilation openings can be arranged so as to be distributed over the periphery of the housing and spaced apart from one another. According to a further embodiment, a support web which divides the constriction may be arranged between two bulkheads. According to a further embodiment, a total of two ventilation openings with in each case a single bulkhead may be provided and the ventilation openings may be arranged on diametrically opposite sides of the housing. According to a further embodiment, the ventilation duct may have a funnel-shaped widening on that side of the housing which points toward the inner side of the electric motor. According to a further embodiment, those edges of the bulkhead which are aligned toward the motor ventilation opening may be of straight design.

BRIEF DESCRIPTION OF THE DRAWINGS

The invention permits numerous embodiments. In order to further clarify its basic principle, one of said embodiments is illustrated in the drawing and described below. In the drawing.

DETAILED DESCRIPTION

Figure 1:
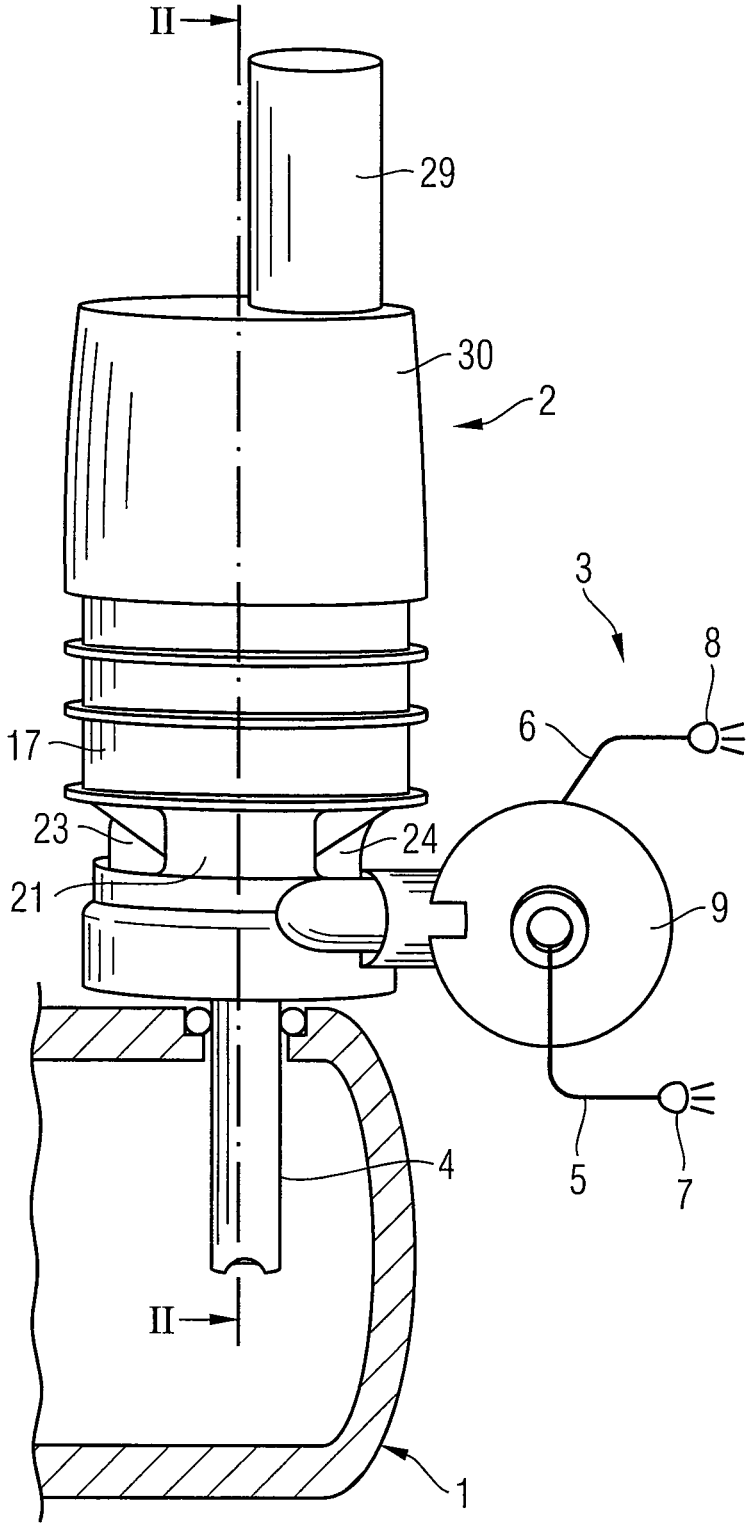
FIG. 1 shows a washer fluid pump according to an embodiment mounted on a washer fluid tank.

According to various embodiments, the bulkhead and that section of the housing which faces toward the pump stage may be produced in one piece and a ventilation duct which is guided from the interior of the electric motor up to behind the bulkhead to the ventilation opening may be arranged parallel to the bulkhead.

By means of this design, it is possible for the housing to be produced from plastic in an injection-molding process in a single, axially demoldable injection-molding die. This leads to simple production of the housing. In addition, the housing is produced in one piece together with the bulkhead, which leads to particularly simple assembly of the washer fluid pump according to an embodiment. As a result of the ventilation duct being guided parallel to the bulkhead, it is also possible in a simple manner to generate a labyrinth, which ensures a particularly high level of spray water tolerance of the washer fluid pump according to an embodiment. The labyrinth permits calming of the air during pressure compensation and, on account of the high level of spray water tolerance, a virtually free selection of the arrangement of the washer fluid pump in the motor vehicle.

According to an embodiment, it may be conducive to the simplification of the production of the housing if the housing has a section of the electric motor which faces toward the pump stage, and a section of the pump stage which faces toward the electric motor, in that the two sections are produced in one piece, in that a constriction is arranged between the two sections and in that the bulkhead partially overlaps the constriction.

A discharge of spray water can be easily ensured at different angles of inclination of the washer fluid pump if a plurality of bulkheads and ventilation openings are arranged so as to be distributed over the periphery of the housing and spaced apart from one another.

Surge protection for further protection against the propagation of spray water to the ventilation openings is of particularly simple structural design if a support web which divides the constriction is arranged between two bulkheads. The support web also increases the stability of the housing.

The washer fluid pump according to an embodiment is of particularly simple structural design if a total of two ventilation openings with in each case a single bulkhead are provided and if the ventilation openings are arranged on diametrically opposite sides of the housing.

Reliable guidance of liquid out of the electric motor can be ensured in a simple manner according to another embodiment if the ventilation duct has a funnel-shaped widening on that side of the housing which points toward the inner side of the electric motor.

Simple demolding of the injection-molding die necessary for the production of the housing can be ensured in a simple manner if those edges of the bulkhead which are aligned toward the ventilation opening are of straight design. This contributes to the further simplification of the production of the washer fluid pump according to an embodiment.

FIG. 1 shows a washer fluid pump 2 mounted on a washer fluid tank 1 and, schematically, adjoining regions of a windshield washer system 3 of a motor vehicle. In order to simplify the drawing, only a partial region of the washer fluid tank 1 is illustrated. The washer fluid pump 2 extends with a suction pipe 4 into the washer fluid tank 1 and feeds washer fluid via washer fluid lines 5, 6 selectively to a first washer nozzle 7 or to a second washer nozzle 8 of the windshield washer system 3. The washer nozzles 7, 8 can be arranged in front of different windows (not illustrated here) of the motor vehicle. For this purpose, the washer fluid pump 2 is connected to a shuttle valve 9 which has two outlets 10, 11 and which selectively connects one of the washer nozzles 7, 8 to one of two outlet pipes 13, 14 of the washer fluid pump 2 as a function of a rotational direction of a rotor 12 illustrated in FIG. 2. The two outlet pipes 13, 14 are illustrated in FIG. 3.

Figure 2:
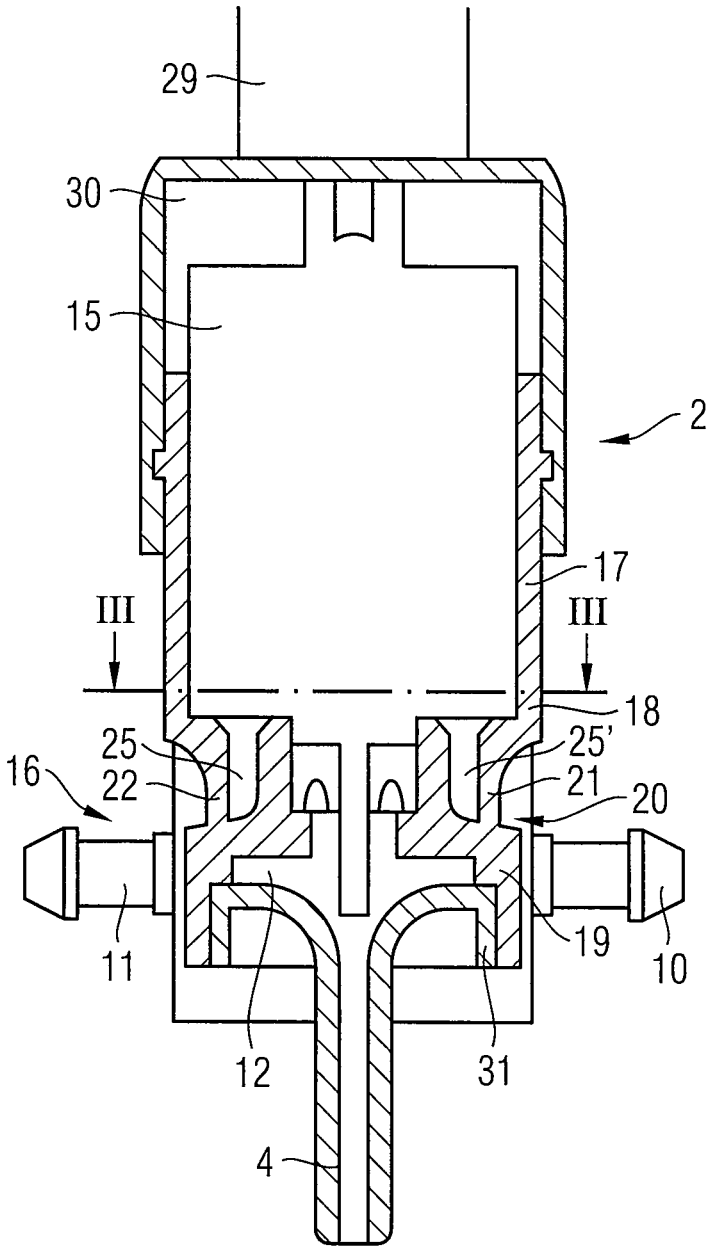
FIG. 2 shows a section illustration through the washer fluid pump according to an embodiment from FIG. 1 along the line II-II.

FIG. 2 shows the washer fluid pump 2 from FIG. 1 in a section illustration along the line II-II. Here, it can be seen that the washer fluid pump 2 has a pump stage 16 which is driven by an electric motor 15. A housing 17 for holding that end of the electric motor 15 which faces toward the pump stage 16 has a section 18 which surrounds a partial region of the electric motor 15 and a section 19 which surrounds the rotor 12 of the pump stage 16. The sections 18, 19 are produced in one piece with one another and have, at their region in which they abut against one another, a constriction 20. The sections 18, 19 are connected to one another by means of two diametrically oppositely arranged bulkheads 21, 22 and by means of support webs 23, 24 illustrated in FIG. 1. The support webs 23, 24 are arranged perpendicular to the longitudinal axis of the washer fluid pump 2, while the bulkheads 21, 22 are arranged in the peripheral direction of the housing 17. A cap 30 which has an electrical connection 29 for the electric motor 15 closes off the upper side of the housing 17. At the side of the pump stage 16, the housing 17 is closed off by a cover 31 which has the suction pipe 4.

Figure 3:
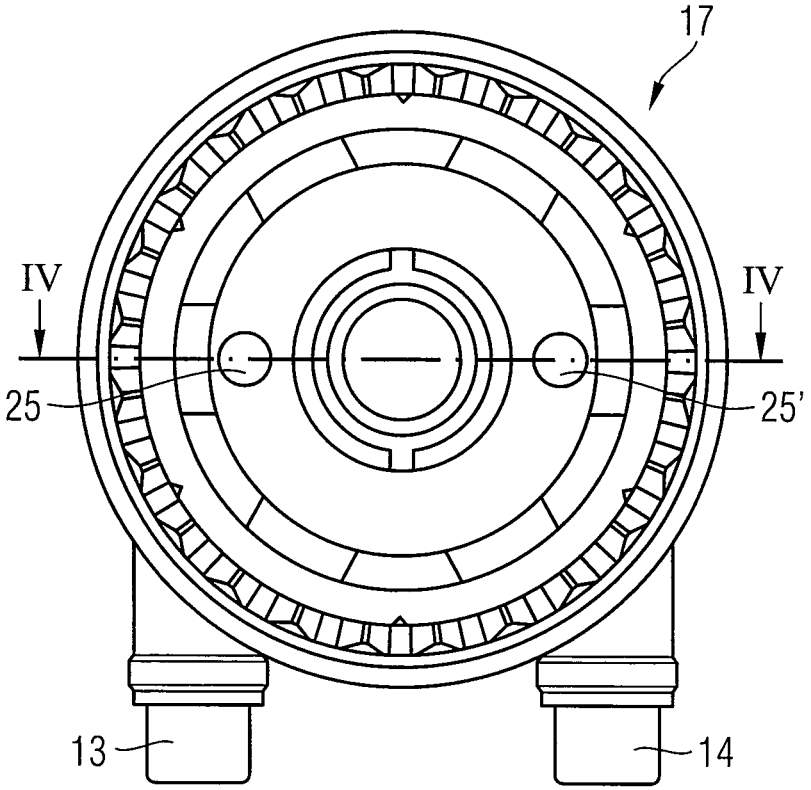
FIG. 3 shows an enlarged section illustration through a housing of the washer fluid pump according to an embodiment from FIG. 2 along the line III-III.
Figure 4:
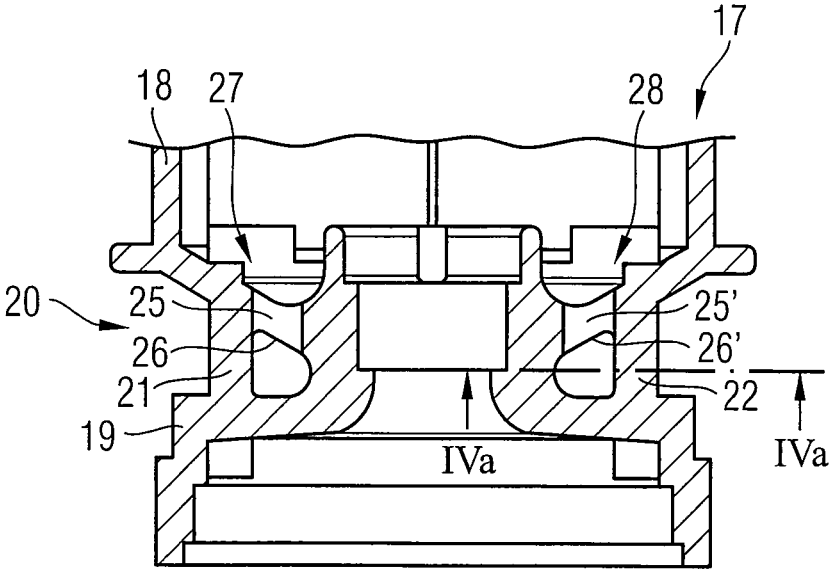
FIG. 4 shows a section illustration through the housing from FIG. 3 along the line IV-IV.

FIG. 3 shows, in an enlarged section illustration through the housing 17 along the line III-III, two ventilation ducts 25, 25', which are arranged in the housing 17, of the electric motor 15. The housing 17 is illustrated in the region of the constriction 20 in a section illustration along the line IV-IV in FIG. 4. In contrast to the view from FIG. 2, the components of the electric motor 15 and of the pump stage 16 are not illustrated here. The bulkheads 21, 22 cover in each case one ventilation opening 26, 26', which is arranged in the constriction 20, of the ventilation ducts 25, 25'. The ventilation ducts 25, 25' have, at their end facing toward the electric motor 15, a funnel-shaped widening 27, 28 and are arranged parallel to the bulkheads 21, 22 and perpendicular to the longitudinal axis of the washer fluid pump 2. The guidance of the ventilation ducts 25, 25' permits particularly simple production of the housing 17 from plastic in an injection-molding process.

Figure 4A:
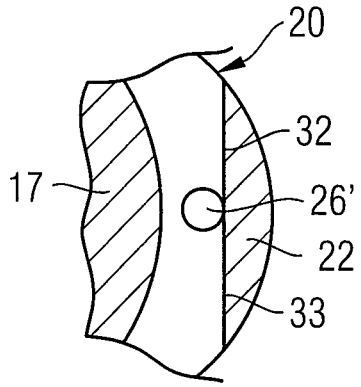
FIG. 4*a* shows a greatly enlarged section illustration through the housing from FIG. 4 along the line IVa-IVa.

FIG. 4*a* shows, in a section illustration along the line IVa-IVa through a partial region of the constriction 20 of the housing 17 that those edges 32, 33 of the bulkhead 22 which adjoin the ventilation opening 26 are of straight design in order to simplify the production of the housing 17. As a result of the arrangement of the ventilation opening 26 behind the bulkhead 22, a labyrinth is generated which permits a discharge of liquid out of the electric motor 15 and prevents an infiltration of spray water into the electric motor 15.

Figure 4B:
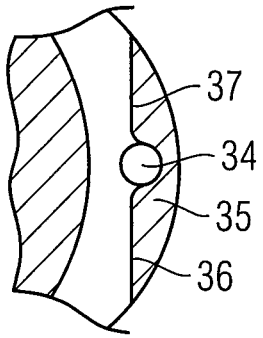
FIG. 4*b* shows an alternative embodiment of an arrangement of a ventilation opening to the view from FIG. 4*a*.

FIG. 4*b* shows a further embodiment of the arrangement of a ventilation opening 34 partially within a bulkhead 35. Here, too, edges 36, 37 of the bulkhead 35 which adjoin the ventilation opening 34 are of straight design.

Figure 5:
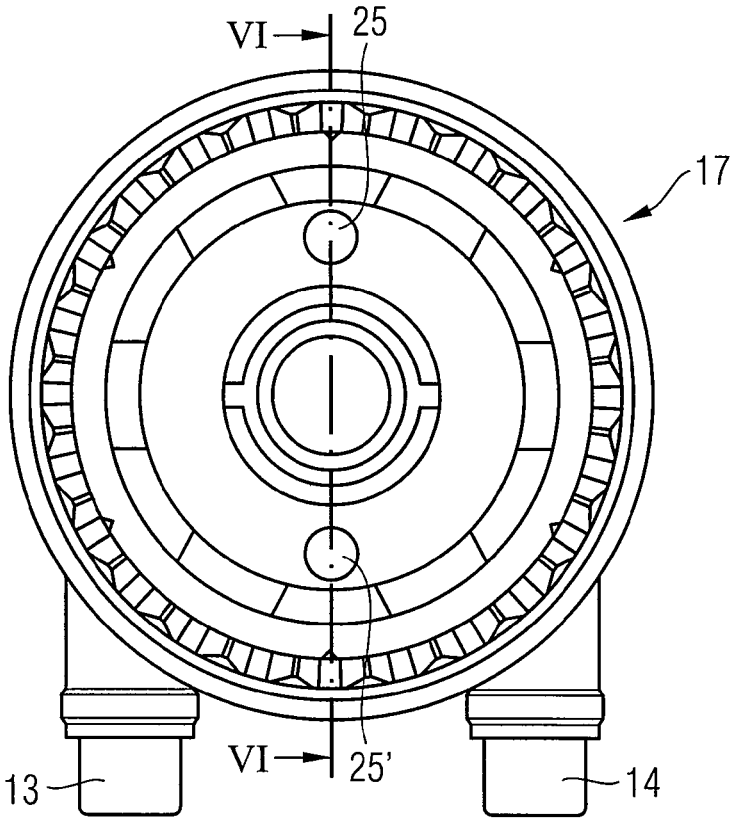
FIG. 5 shows a further embodiment of the housing in a section illustration corresponding to FIG. 3.
Figure 6:
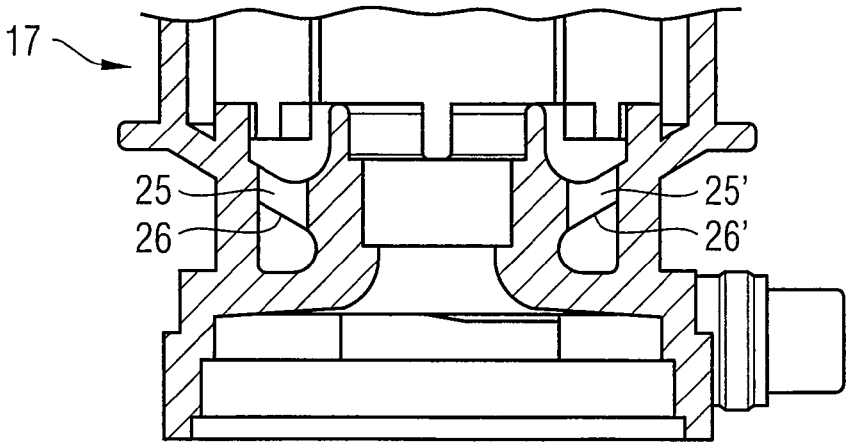
FIG. 6 shows a section illustration through the embodiment illustrated in FIG. 5, along the line VI-VI.

FIG. 5 shows a further embodiment of the housing 17 which differs from that of FIG. 3 only in that the ventilation ducts 25, 25' are offset by 90° in relation to those from FIG. 3. For clarification, FIG. 6 shows, in a section illustration along the line VI-VI, the offset arrangement of the ventilation ducts 25, 25' and therefore of the ventilation openings 26, 26'.

What is claimed is:

1. A washer fluid pump for a windshield washer system of a motor vehicle comprising:

an electric motor extending in an axial direction, a pump stage driven by the electric motor, a housing including two sections separated from each other in the axial direction and two bulkheads extending in the axial direction to connect the two sections, the two bulkheads being separated and spaced apart from each other around a periphery of the housing, each bulkhead extending partially around an outer circumference of the housing from a first lateral edge of the respective bulkhead to a second lateral edge of the respective bulkhead, thereby allowing flow between the two bulkheads, wherein each bulkhead covers a single associated ventilation opening of an associated ventilation duct, the ventilation duct extending in an axial direction, wherein the associated ventilation duct opens through its ventilation opening into an associated outlet area defined by the first and second lateral edges of the bulkhead which adjoin the ventilation opening, so that a fluid passing through a respective ventilation opening may pass between the two bulkheads without passing another ventilation opening, each ventilation opening being spaced apart from an interior of the electric motor in the axial direction, the housing formed in a unitary piece, wherein two ventilation ducts are formed within the housing on diametrically opposite sides of the housing extending in the axial direction from the interior of the electric motor to the associated outlet area behind the two bulkheads, respectively, such that each of the two axially-extending ventilation ducts is in fluid communication with a corresponding outlet area and configured to vent to an area outside the housing via said outlet areas.

2. The washer fluid pump according to claim 1, wherein a radial constriction is arranged between the two sections of the housing and wherein each of the two bulkheads partially overlaps the constriction.

3. The washer fluid pump according to claim 1, wherein a support web which divides a constriction is arranged between the two bulkheads.

4. The washer fluid pump according to claim 1, wherein the ventilation duct has a funnel-shaped widening on a side of the housing which points toward the inner side of the electric motor.

5. A method of producing a washer fluid pump for a windshield washer system of a motor vehicle comprising the steps of:

producing a unitary housing including two sections separated from each other in an axial direction and a plurality of bulkheads extending in the axial direction to connect the two sections, installing an electric motor and a pump stage in the two sections of the unitary housing, wherein the electric motor drives the pump stage, wherein the plurality of bulkheads are separated and spaced apart from each other around a periphery of the housing, each bulkhead extending partially around an outer circumference of the housing from a first lateral edge of the respective bulkhead to a second lateral edge of the respective bulkhead, and each bulkhead covering a single respective ventilation opening of an associated ventilation duct, the ventilation duct extending in an axial direction, wherein the associated ventilation duct opens through its ventilation opening into an associated outlet area defined by the first and second lateral edges of each bulkhead which adjoin the ventilation opening, so that a fluid passing through a respective ventilation opening may pass between bulkheads without reaching another ventilation opening, wherein each ventilation opening is spaced apart from an interior of the electric motor in the axial direction, and providing each ventilation duct within the unitary housing extending in the axial direction from the interior of the electric motor to the associated outlet area behind one of the plurality of bulkheads such that each axially-extending ventilation duct is in fluid communication with a corresponding outlet area and configured to vent to an area outside the housing via the outlet area.

6. The method according to claim 5, wherein a radial constriction is arranged between the two sections of the housing and wherein the plurality of bulkheads partially overlaps the constriction.

7. The method according to claim 5, wherein a support web which divides a constriction is arranged between two bulkheads.

8. The method according to claim 5, wherein a total of two outlet areas, each associated with a corresponding bulkhead, are arranged on diametrically opposite sides of the housing.

9. The method according to claim 5, wherein the ventilation duct has a funnel-shaped widening on a side of the housing which points toward the inner side of the electric motor.

10. A washer fluid pump for a windshield washer system of a motor vehicle comprising:

a housing including two sections separated from each other in an axial direction and a plurality of bulkheads extending in the axial direction to connect the two sections, an electric motor disposed in a first section of the two sections extending in the axial direction, a pump stage disposed in the second section of the two sections and driven by the electric motor, and the plurality of bulkheads of the housing spaced apart from each other spaced around a periphery of the housing such that each bulkhead extends partially around an outer circumference of the housing from a first lateral edge of the respective bulkhead to a second lateral edge of the respective bulkhead and allowing flow between each set of adjacent bulkheads, wherein each bulkhead covers a single respective ventilation opening of an associated ventilation duct, the ventilation duct extending in an axial direction, wherein the associated ventilation duct opens through its ventilation opening into an associated outlet area defined by the first and second lateral edges of the bulkhead which adjoin the ventilation opening, so that a fluid passing through a respective ventilation opening may flow between bulkheads without passing another ventilation opening, each ventilation opening being spaced apart from an interior of the electric motor in the axial direction, the housing formed in a unitary piece, wherein the ventilation ducts formed within the housing extending in the axial direction from the interior of the electric motor to the associated outlet area behind one of the plurality of bulkheads such that the ventilation duct is in fluid communication with the corresponding outlet area and configured to vent to an area outside the housing via the outlet areas.

11. The washer fluid pump according to claim 10, wherein a support web which divides a constriction is arranged between two bulkheads.

12. The washer fluid pump according to claim 10, wherein a total of two outlet areas, each associated with a corresponding bulkhead, are arranged on diametrically opposite sides of the housing.

13. The washer fluid pump according to claim 10, wherein the ventilation duct has a funnel-shaped widening on a side of the housing which points toward the inner side of the electric motor.

* * * * *